US008459847B2

(12) United States Patent
Salm

(10) Patent No.: US 8,459,847 B2
(45) Date of Patent: Jun. 11, 2013

(54) GOBO HOLDER FOR A GOBO WHEEL, AND GOBO WHEEL

(75) Inventor: Markus Salm, Heusweiler (DE)

(73) Assignee: GLP German Light Products GmbH, Karlsbad (DE)

( * ) Notice: Subject to any disclaimer, the term of this patent is extended or adjusted under 35 U.S.C. 154(b) by 397 days.

(21) Appl. No.: 12/743,181

(22) PCT Filed: Nov. 3, 2008

(86) PCT No.: PCT/EP2008/009250

§ 371 (c)(1),
(2), (4) Date: Sep. 15, 2010

(87) PCT Pub. No.: WO2009/062607

PCT Pub. Date: May 22, 2009

(65) Prior Publication Data

US 2011/0090708 A1 Apr. 21, 2011

(30) Foreign Application Priority Data

Nov. 16, 2007 (DE) ..... 10 2007 054 827
Feb. 15, 2008 (DE) ..... 10 2008 009 257

(51) Int. Cl.
*F21V 17/02* (2006.01)

(52) U.S. Cl.
USPC ..... 362/449; 362/282; 362/283; 362/322; 362/457

(58) Field of Classification Search
USPC ..... 362/449, 457, 458, 322–324, 282–284, 362/293, 277, 319, 433
See application file for complete search history.

(56) References Cited

U.S. PATENT DOCUMENTS

| | | | | |
|---|---|---|---|---|
| 5,402,326 | A * | 3/1995 | Belliveau | 362/284 |
| 6,402,344 | B1 * | 6/2002 | Palazzo | 362/283 |
| 6,601,973 | B2 * | 8/2003 | Rasmussen et al. | 362/282 |
| 7,370,990 | B2 * | 5/2008 | Juřik | 362/227 |
| 7,736,022 | B2 * | 6/2010 | Jurik | 362/283 |
| 7,905,630 | B2 * | 3/2011 | Dalsgaard | 362/281 |
| 8,042,974 | B2 * | 10/2011 | Sherman et al. | 362/321 |
| 8,262,262 | B2 * | 9/2012 | Mahaffey | 362/322 |
| 2002/0075685 | A1 * | 6/2002 | Rasmussen et al. | 362/282 |
| 2009/0323355 | A1 * | 12/2009 | Mahaffey | 362/323 |

* cited by examiner

*Primary Examiner* — Bao Q Truong
(74) *Attorney, Agent, or Firm* — Glenn Patent Group; Michael A. Glenn

(57) ABSTRACT

A gobo holder for a gobo wheel has a base element, a gobo fastening element rotatably mounted to the base element, and a resilient latching member on the base element. The gobo holder is mounted to a gobo wheel having a latching feature for such time until a mechanical latching connection is achieved between the resilient latching member of the gobo holder and the latching feature of the gobo wheel.

25 Claims, 4 Drawing Sheets

GOBO HOLDER FOR A GOBO WHEEL, AND GOBO WHEEL

CROSS-REFERENCE TO RELATED APPLICATION

This application is a U.S. National Phase entry of PCT/EP2008/009250 filed Nov. 3, 2008, and claims priority to German Patent Application No. 102007054827.5 filed Nov. 16, 2007, each of which is incorporated herein by references hereto.

BACKGROUND OF THE INVENTION

The present invention relates to lighting effect systems, and in particular to gobo holders for gobo wheels, and to gobo wheels.

Automated illuminating systems are employed in entertainment applications, advertisement applications or architectural applications. Such illuminating systems are light projectors which manipulate a light beam to create different lighting effects.

Common projectors for stage applications, theater applications, architectural applications and other kinds of illumination comprise means for removable insertion of various types of modifiers for an optical beam, namely into the path of a light beam so as to vary the color, intensity, size, shape and structure of the light beam. In a typical system, a light source creates white light passed, for example, through at least one color filter wheel so as to create a colored light beam. Also, the light may be passed through a gobo wheel so as to impress a selected structure upon the light beam. In addition, light intensity wheels are employed for varying the intensity of the light transmitted. Also, there are means which represent a mechanical iris in order to determine the beam size. Moreover, there are also lens systems for controlling the focus of the light beam and the divergence of the light beam. Also, effect wheels are used for being placed into the light beam so as to then create a flame or similar effects, for example, by a concerted action of a gobo wheel and an effect wheel.

U.S. Pat. No. 6,601,973 discloses a system and a method for replacing gobos within a compact projector which has rotatable gobo holders provided therein which may simply be mounted to or removed from a gobo carrousel or gobo wheel. Such a gobo wheel comprises a rotatable base plate, a central planetary gear and a spring holder at the base plate, said spring holder being configured to elastically accommodate a gobo holder.

The base plate may comprise six openings arranged around a central axis of the base plate and spaced apart from one another at the same time. These openings, or some of these openings, can accommodate one gobo holder each. The base plate further comprises a central hub extending outward from a surface of the base plate to be mounted to a rotatable shaft of a motor so as to rotate the base plate such that one of the gobo holders will be positioned within the light path.

Moreover, a spring holder is mounted to the base plate. In addition, a central planet wheel is coupled to a drive motor via a rotatable shaft. In this manner, the drive motor rotates with the entire gobo base plate, whereas the planet wheel, which has an axis which coincides with the axis of the hub, is able to be rotated independently of the rotation of the base plate. Typically, a circumferential edge of the central planet wheel has cogs formed around it which engage with gears which are each arranged on a gobo holder around the circumference of same, such that the gobo holders are rotated when the planet wheel is rotated.

Each gobo holder comprises a gobo fastener, which comprises a cylindrical portion having first and second ends. An annular plate defines an opening. In addition, a projecting plate is formed within the inner circumference of a cylindrical portion adjacent to a second end. A spring is used for being able to reliably and efficiently fasten a gobo to the gobo holder.

WO 2004/046607 A1 also discloses a gobo wheel which has replaceable segments comprising gobos arranged thereon. These replaceable segments are gobo holders comprising a base plate which is formed as a shaped lamella. The base plate has a bearing fixedly mounted to it by means of which a gear, to which a gobo may be connected, may be rotated in relation to the base plate. A shaped lamella at the base plate is configured to engage with a central holder riveted onto the gobo wheel. In particular, the central holder comprises one finger for each base plate. Also, recesses are provided within the base plate for alignment purposes, which, once a gobo holder has been inserted, engage with respective alignment studs, or cylindrical heads of screws. The gobo holder is held by means of the elastic action of the spring finger.

Well-known possibilities of fastening a gobo holder to a gobo wheel thus consist in that an elastic element is provided which is fixedly connected to the gobo wheel and which, when a gobo holder is mounted, is deflected and exerts a spring force on the gobo holder. The gobo holder itself, by contrast, is not configured to be elastic, but to be rigid.

On the other hand, increasing requirements placed upon such automated light systems, which are also referred to as "moving heads", entail ever-increasing demands for flexibility and more and more lighting effects. This results in that since quite a long time ago, one can no longer assume that one single process of populating a gobo wheel with several gobo holders, and thus various gobos, would meet all needs. Instead, a significantly larger number of gobos are typically provided than have room on one gobo wheel. In order to be able to create the gobo lighting effects desired for specific applications, the gobos desired by the light artist are therefore incorporated into the lamp prior to using a "moving head". Replacing the gobos themselves is not an option, since being continuously installed into and de-installed from a gobo holder is something that gobos would not survive for long.

As a result, the only option remaining is to replace gobo holders, as is described in the previously cited documents. This results in that the spring suspension of the gobo wheel is constantly under stress because of the frequent engaging and disengaging of the gobo holders on the gobo wheel. The spring members become weaker over time, which in the extreme case may result in that the gobo holders are no longer reliably fastened to the gobo wheel, and that at some point a gobo wheel will be replaced. However, these are unpleasant and costly repairs which are problematic particularly also in that they lead to additional idle time.

Such "moving heads" are typically no longer bought on a large-scale basis, but are rented from an event organizer for specific installations. However, lenders of a moving head can only work in a cost-covering or profitable manner if their moving heads have no idle times. However, if the spring fixtures on the gobo wheel slacken more and more due to frequent replacement of gobo holders, repairs would be needed at some point in that entire gobo wheels would have to be replaced because maybe only one single spring member of a gobo holder which was to be replaced is defective. In addition, this problem is aggravated in that, in particular in rental applications, gobo applications often entail inexpert handling of the moving heads and of the sensitive components, which leads to a significantly higher probability of damage occurring as compared to any situation where such a moving head is carefully handled by trained qualified personnel only.

SUMMARY

According to an embodiment, a gobo holder for a gobo wheel may have: a base element; and a gobo fastening element rotatably mounted to the base element, the base element having at least one resilient latching member configured to form a mechanical latching connection with a latching feature on the gobo wheel, by which mechanical latching connection the gobo holder may be detachably connected to the gobo wheel.

According to another embodiment, a gobo wheel for accommodating a gobo holder which includes a resilient latching member, may have: a base plate having a recess for the gobo holder; and a latching feature configured to form a mechanical latching connection with the resilient latching member of the gobo holder, by which mechanical latching connection the gobo holder is detachably connected to the gobo wheel.

According to still another embodiment, a method of fastening a gobo holder, which includes a resilient latching member, to a gobo wheel, which includes a latching feature, may have the step of: creating a relative motion between the gobo wheel and the gobo holder along a latching-motion direction for such time until the resilient latching member latches into the latching feature of the gobo wheel.

The present invention is based on the finding that resilient parts, i.e. wearing parts, as it were, are to be located on gobo holders rather than on gobo wheels. When a gobo holder is provided with a resilient element, e.g. a resilient latching member, wearout of this resilient latching member will at the most result in a single gobo holder being discarded and being replaced by a new gobo holder. All other gobo holders, or the gobo wheel itself, comprise fewer wearing parts as a result of the reduced number or lack of resilient elements. In this manner, maximum robustness is achieved for the gobo wheel, and no repairs will have to be performed on the gobo wheel or on the plug-in unit within the moving head supporting the gobo wheel. Thus, no off-times will be caused by any repairs made on the gobo wheel.

However, since a gobo holder comprises a resilient elastic latching member, this resilient latching member may at some point actually wear out to such an extent that it may lose its desired spring effect. Then, such a gobo holder will simply be replaced. However, for this purpose the moving head need not be engaged, but the gobo holder is simply disengaged as if one were inserting a different gobo holder comprising a different gobo wheel. The "repair work" caused by a gobo holder comprising a worn-out latching member is thus easy to perform, namely by ordinary operators rather than by qualified personnel, since the "repair process" proceeds in exactly the same manner as an ordinary replacement operation of a gobo holder on the gobo wheel.

In accordance with the invention, a gobo holder comprises a base element and a gobo fastening element rotatably mounted to the base element, the base element comprising at least one resilient latching member configured to form a mechanical latching connection with a latching feature on the gobo wheel, the gobo holder being detachably connected to the gobo wheel by said mechanical latching connection. By analogy therewith, the gobo wheel, which is configured to accommodate at least one gobo holder comprising a resilient latching member, includes a base plate comprising a recess for the gobo holder, and a latching feature configured to form a mechanical latching connection with the resilient latching member of the gobo holder, by which mechanical latching connection the gobo wheel may be detachably connected to the gobo holder. The latching members may be configured as resilient elements on the gobo holder which are integrally connected to a base plate of the gobo holder. These resilient elements latch into recesses or, maybe, perforations on the gobo wheel.

In order to have a correct alignment in the event that the latching elements themselves do not yet provide complete alignment of the gobo holder, it is of advantage to provide alignment elements on the gobo wheel which engage with guide areas on the gobo holder so as to correctly guide the gobo holder while the latching connection latches into place, and to correctly retain the gobo holder in its position in the latched state.

These latching elements may be fixed pins protruding from the base plate of the gobo wheel and having a neck and a head in each case, the head protruding beyond the neck, which results in that the latching pins, and in particular the heads of the respective latching pins, retain the gobo holder in a vertical direction. The force generated in the process results in that the resilient latching member is retained in the latched state.

BRIEF DESCRIPTION OF THE DRAWINGS

Embodiments of the present invention will be explained in detail below with reference to the accompanying figures, wherein.

DETAILED DESCRIPTION OF THE INVENTION

Figure 1:
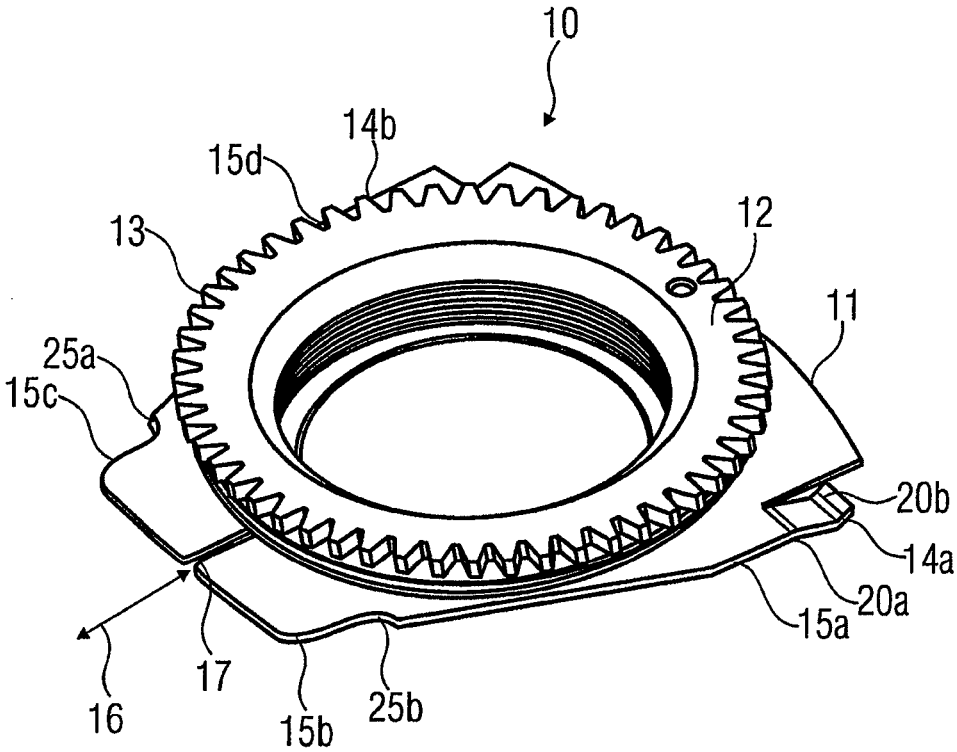
FIG. 1 shows a top view of a gobo holder.

FIG. 1 shows a gobo holder 10 for a gobo wheel. The gobo holder comprises a base element 11 connected to a gobo fastening element 12. In particular, the gobo fastening element 12 is rotatably mounted to the base element 11. The gobo fastening element 12 is configured to hold a circular gobo, which is not depicted in FIG. 1. Around its circumference, the gobo fastening element comprises cogs 13 which may engage with other cogs of a drive gear or, e.g., a cog belt, which may be centrally fastened to a gobo wheel, for example, as will be set forth below. The gobo holder shown in FIG. 1 comprises at least one resilient latching member 14*a*, 14*b*. In particular, FIG. 1 shows an arrangement comprising two resilient latching members 14*a*, 14*b*, each latching member being configured to form, with a latching feature on the gobo wheel which is not shown in FIG. 1, a mechanical latching connection by means of which the gobo holder may be detachably connected to the gobo wheel. The base element comprises several guide areas, each guide area being configured to engage with a guide feature on the gobo wheel during a latching operation. In the embodiment shown in FIG. 1, the guide areas are realized as the outer edges of the base element at the locations designated by the reference numerals. Of course, other guide areas are also feasible. In particular, in the example shown in FIG. 1, however, there are guide areas which are arranged at a distance from one another and are configured such that during a latching operation, they engage with guiding features of the gobo wheel which are arranged at a distance from one another, so as to restrict, during the latching operation, a motion of the gobo holder in a direction which is orthogonal to a latching direction. For the gobo holder depicted in FIG. 1, the latching direction is represented by a directional arrow 16, a leftward motion with regard to FIG. 1 resulting in a latching, and a rightward motion in FIG. 1 leading to a de-latching, i.e. when the gobo holder is to be removed from the gobo wheel.

The front area of the fastening element is provided with a slot 17 which exists in order to achieve a certain compliance in the front area of the base element, as will be set forth below. This slot is provided in that area of the base element which in the latched state is directed to a center of the gobo wheel, this flat area comprising two opposed edges 15*c*, 15*b* which form the guide areas, and the flat area comprising, as has been set forth, the slot 17, which is formed between the guide areas.

The slot 17 is further advantageous in that the front slotted area may engage, when it acts as a spring, with a ring groove within a ball bearing. The slot then enables this spring to be over-stretched so as to achieve fastening within the ball bearing.

Figure 2:
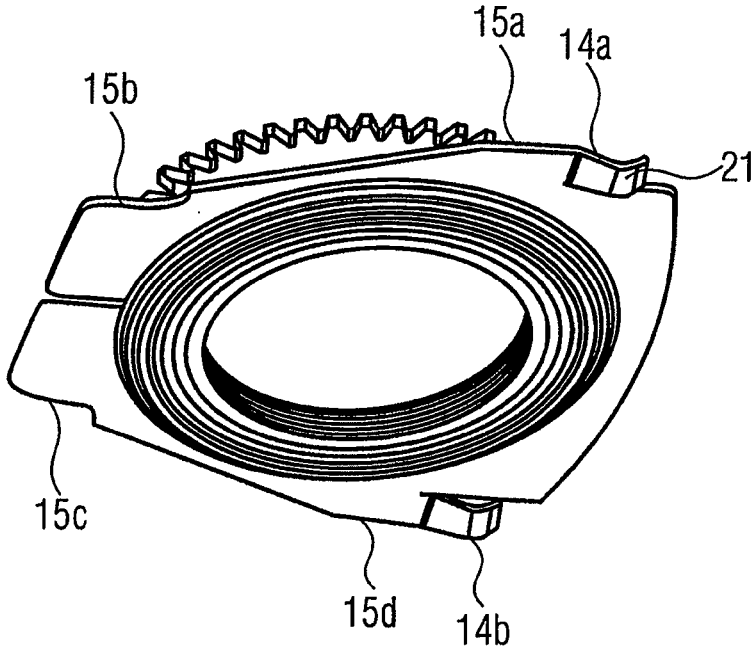
FIG. 2 shows a bottom view of the gobo holder.

In the embodiment shown in FIG. 1, the resilient latching member is shaped as an elastic lug protruding beyond a surface of the base element 11, which is configured in a planar manner. In addition, as is depicted in FIGS. 1 and 2, two separately arranged latching members are provided which are arranged on a connecting line which is not parallel to a direction 16 in which the gobo holder is moved when it is moved in relation to the gobo wheel so as to form the latching connection. In the embodiment shown in FIG. 1, the resilient latching member is integrally formed with the base element 11. Here, e.g. spring steel or any other robust element which, however, has a certain elasticity, may be used. To increase elasticity, the latching member is provided with a first bending edge 20*a* and a second bending edge 20*b*. A strip extends from the first bending edge 20*a* to the second bending edge 20*b* beyond the plane of the base element 11. From the second bending edge 20*b* to the end of the strip, the material again extends to the plane of the base element so that an area is formed around the second bending edge 20*b* which slides on the base plate of the gobo wheel until latching occurs. This area is designated by 21 in FIG. 2.

Figure 6:
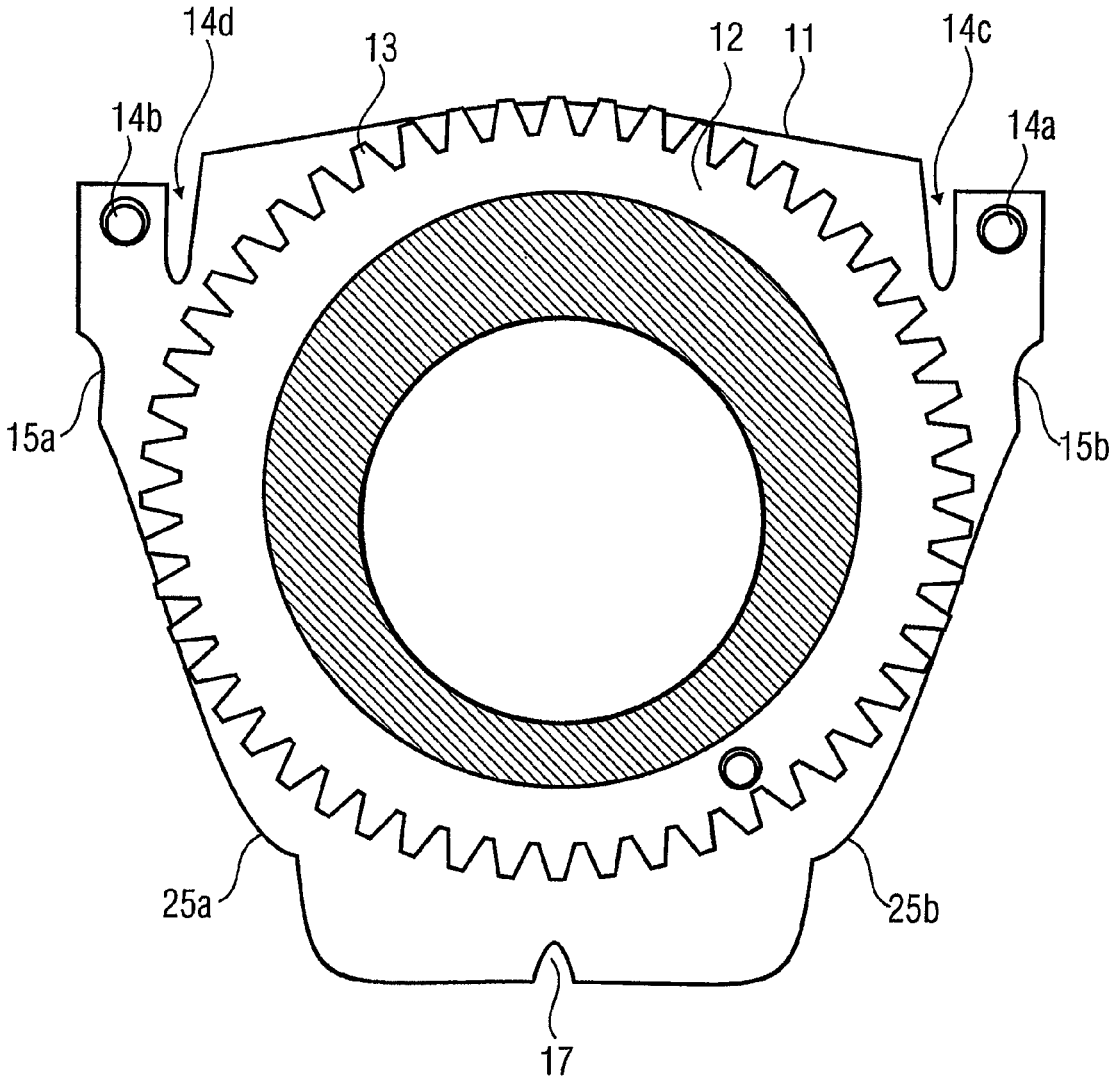
FIG. 6 shows a top view of an alternative gobo holder comprising an inserted gobo.

FIG. 6 shows an alternative implementation of a gobo holder. Unlike the embodiment shown in FIG. 1, wherein the resilient latching member 14*a* or 14*b* has been realized by an offset element comprising several bending edges, in the alternative embodiment shown in FIG. 6, the latching member has been replaced by a spherical stamp. The top view shows the trace left by the stamping tool. Thus, a hemispherical protrusion into which the latching feature of the gobo wheel may engage is located on the underside of the latching member. Because of the provision of the slots 14*c* and 14*d*, the strip in which the stamps 14*a* and 14*b* are located is offset from the entire base element 11, so that the strip obtains a level of elasticity which enables the strip comprising the stamp to be slightly deflected without bending edges being provided.

The spherical stamps shown in FIG. 6 are favorable in that they may be manufactured with a high level of precision and ensure high functionality.

All in all it is of advantage to configure the base element to be trapezoidal, such that in a rear area, which is directed outward once latching has occurred, there is a larger width than in the interior area. This results in that the alignment at the alignment pins works better since the gobo holder is guided well during latching.

In addition, it shall also be noted that the gobo holder contains a bearing which enables the rotational motion of the gobo holder when the drive wheel is inserted in the center, said drive wheel engaging with the cogs 13 of the gear 12 so as to rotate the gobo holder.

Figure 3:
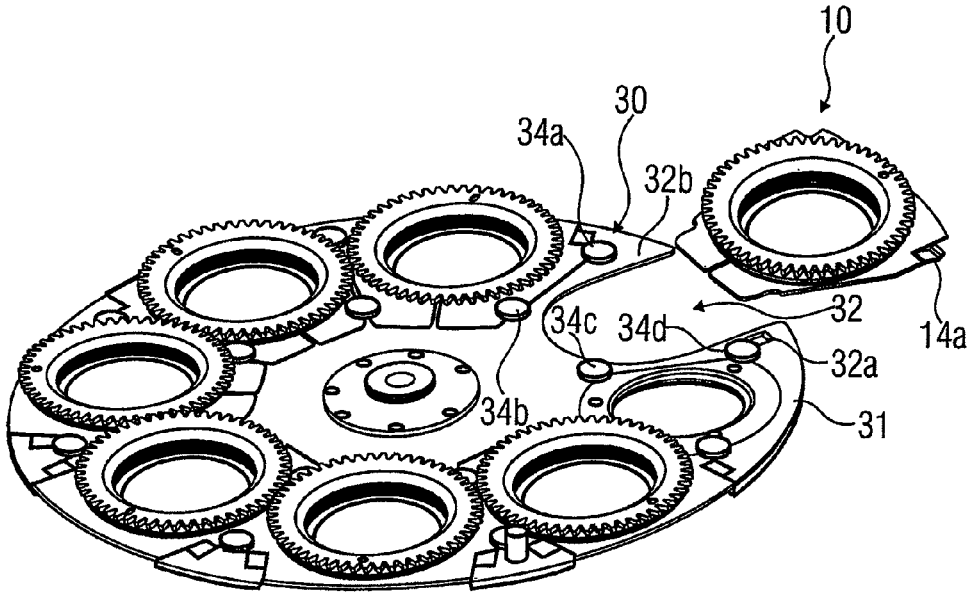
FIG. 3 shows a gobo wheel comprising six gobo holders which have been mounted, and a seventh gobo holder which has not yet been mounted.

FIG. 3 shows a gobo wheel 30 for accommodating at least one gobo holder 10 which, as was described by means of FIGS. 1 and 2, includes at least one resilient latching member 14*a*. The gobo wheel includes a base plate 31 comprising a recess 32 for the gobo holder 10. In addition, the gobo wheel includes a latching feature configured to form a mechanical latching connection with the resilient latching member 14*a* of the gobo holder, by means of which mechanical latching connection the gobo holder may be detachably connected to the gobo wheel. In the embodiment shown in FIG. 3, the latching feature is a recess, or perforation, 32*a* and 32*b*, respectively. The latching feature may exhibit no elasticity or at the most a level of elasticity which is at least 10 times smaller than a level of elasticity of the resilient latching member of the gobo holder. In this manner, it is ensured that the base plate is less susceptible to wear and tear, since a susceptibility to wear and tear increases as the elasticity of an area or latching feature increases. The latching features 32*a* and 32*b*, respectively, in the form of perforations through the base are very robust, however, since they need not exhibit any elasticity, but the entire elasticity of the latching connection is provided by the resilient lug 14*a*.

The recess 32 extends from a rim of the base plate to a center of the base plate, and, as is shown in FIG. 3, there are two latching features 14*a*, 14*b* which are located closer to the rim than to the center of the base plate next to the recess 32. In this manner, overall stability is improved as compared to any situation where the latching elements are located closer to the center of the base plate, even though this is also possible.

The base plate further comprises at least one guide element, four guide elements being provided, in particular, in the embodiment shown in FIG. 3. As is depicted in FIG. 5*b*, in particular, each guide element comprises a neck 50 and a head 51. The neck 50 is configured such that the guide areas 15*a*, 15*b*, 15*c* and 15*d*, respectively, slide along the neck 50, and that, in addition, the respective guide areas are also supported in a vertical direction by the head 51. This results in that, when the gobo holder latches into the gobo wheel, the base elements are then held downward by the heads of the four guide pins 34*a*, 34*b*, 34*c*, 34*d*, and slide along same. As soon as the sliding area 21 (FIG. 2) of the latching member engages with the base plate of the gobo wheel, the latching member is forced back until it reaches the recesses 32*a* or 32*b*, respectively, said latching member snapping back into the recesses 32*a* or 32*b*, respectively, because of the resiliency of the resilient latching member. Then the gobo holder has latched and is further securely held by the guide pins 34*a* to 34*d*. In addition, the slot 17 (FIG. 1) results in that the two front areas at the guide areas 15*c*, 15*b* or the gobo holder may run along the two front guide pins 34*c*, 34*b*, any tolerances being compensated for by the slot, and further elasticity being provided which even results in that the two front pins 34*b*, 34*c* will also slightly latch into the fillets 25*a*, 25*b*. In this manner, reliable support of the gobo holder is increased even further.

In may further be seen from FIG. 3 and FIG. 5 that it is of advantage to employ a guide pin for holding two adjacent gobo holders. From that point of view, the two elements or base plates 11 which are shown in FIG. 5*b* are base plates which belong to two adjacent gobo holders.

Figure 4:
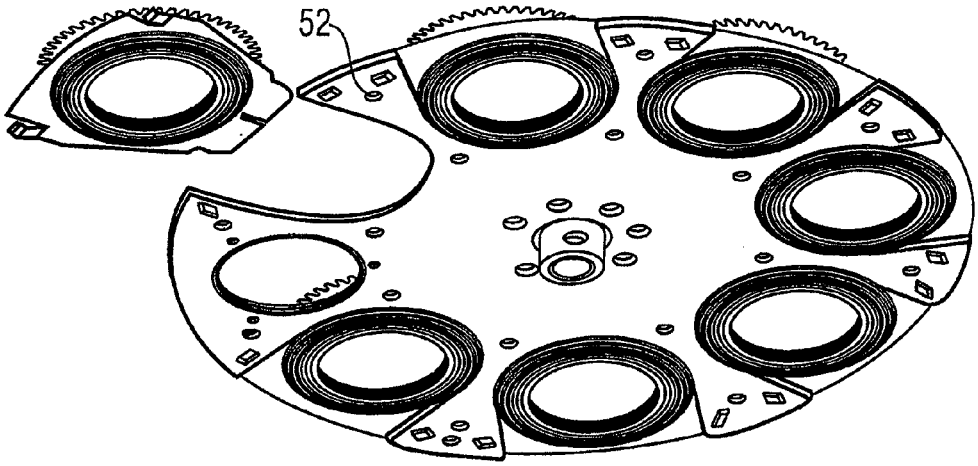
FIG. 4 shows a bottom view of the arrangement of FIG. 3.

The guide pins may be connected to the base plate either by screws or, as is shown in FIG. 5*b*, by rivets, a bottom area 52, which is also shown in FIG. 4, slightly protruding beyond the base plate 31 so that the guide pin is securely held. Alternatively, instead of a rivet joint, one may also use a bolted joint, a welded joint, an adhesive-bonded joint or the like for fastening the guide pins to the base plate 31.

Figure 5A:
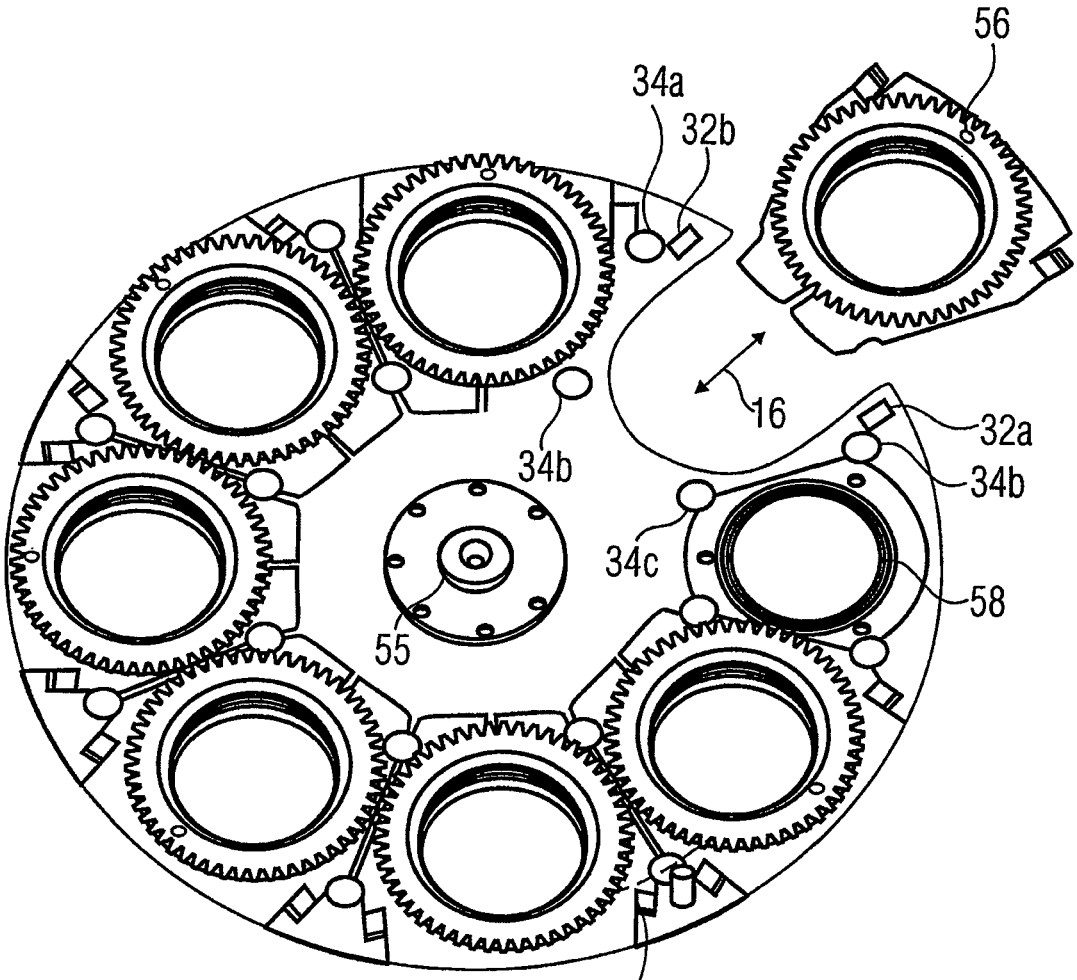
FIG. 5*a* shows a top view of the gobo wheel into which six gobo holders have already latched, and into which a seventh gobo holder has not yet latched.
Figure 5B:
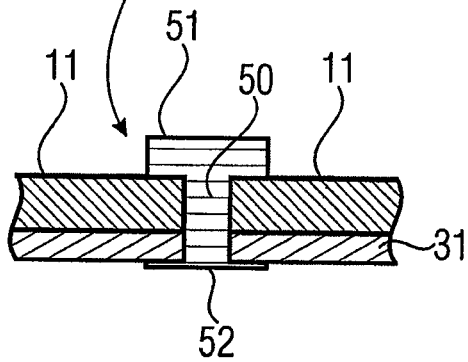
FIG. 5*b* shows a schematic cross-sectional view along the cross-sectional line drawn in in FIG. 5*a* for illustrating the alignment pin.

In addition, the base plate comprises a central hub 55 to which a drive wheel or "planet wheel" may be mounted which engages with all of the gears of the individual gobo holders such that rotating the central gear not shown in FIG. 5*a* results in that all of the gobo holders will also rotate.

Each gobo holder further comprises an alignment feature 56 which may be used for equally aligning all of the gobo holders when it all depends on the interaction between various gobos, or when the manner in which a gobo is circumferentially held by a gobo holder is important for a specific lighting effect to occur.

The gobo wheel shown in FIG. 5*a* has a total of 7 gobo holders and an ordinary light transmission window 58, the light transmission window 58 typically comprising no effect element or the like, but only enabling unimpeded transmission of the light beam. The number of gobo holders on the gobo wheel may be varied, it being of advantage, however, to mount at least three gobo holders on one gobo wheel for reasons of efficiency and space. The gobo wheel itself may be fastened to a plug-in unit for a moving head.

Unlike the embodiments described, the resilient latching member 14*a* of a gobo holder need not necessarily be configured as an integral strip of material, even though this is favorable for cost and manufacturing reasons. A separate spring of a similar shape could be fastened to the base element, e.g. by welding, riveting or adhesive bonding. Alternatively, a spring-loaded sphere could also be provided within the base element, said sphere then engaging into the depressions 32*a* or 32*b*, respectively. For this purpose, it would not be absolutely necessary for the latching elements on the base plate to be through-holes, but depressions within the material would also suffice, provided that sufficient latching action is created in this manner. In addition, it is not absolutely necessary for there to be four guide members. For example, a single guide element could also suffice, which could, e.g., engage into the slot and which is formed to achieve an alignment.

As is shown in FIG. 5*a*, it is of advantage to provide guide elements close to the latching holes 32*a*, 32*b* in that a counter-force, which is as direct as possible, is achieved for the vertical latching force resulting in the spring load on the resilient latching element. Alternatively, however, guide rails or holder elements may be provided, instead of the guide pins, from the other side, said guide rails or holder elements being configured in that a counter-force for the spring deflection is created by means of which latching is ensured. In addition, it is not absolutely necessary for a guide pin to hold only two adjacent gobo holders, but it is also possible for one guide pin to hold only one single gobo holder.

One advantage of the inventive gobo wheel/gobo holder concept is that installation of the gobo holder may be performed radially from the outside, as is shown, e.g., in FIG. 5*a* by the arrow 16. In this manner, the installation space needed for replacement may be reduced to a minimum. In the inventive concept comprising radial installation, the space needed along the optical axis is the same for the gobo replacement and for the operation of the gobo wheel.

In contrast to systems wherein the gobo holder is forced out of a depression within the gobo wheel along the optical axis and is then drawn off to the outside in a radial manner, installation in accordance with the invention is easier. In these less advantageous systems, the space needed along the optical axis for the veering part itself as well as for the fingers of the operator during operation is not available. However, it is precisely in operation that every fraction of a millimeter is highly appreciated, since the optical performance of the system decreases as the distance between the individual gobos increases.

The inventive variant is further advantageous in that the guiding pins 34*b*, 34*c* are situated between the gobo holders and, even though this is not immediately evident from FIG. 5*a*, also in the gap between the gobo holder gear 12 and the central drive wheel not shown in FIG. 5*a*. The thickness of the system is thus reduced to a minimum. Maximum utilization of space is also contributed to by the fact that two gobo holders are held by one and the same stud in each case.

It shall further be noted that the guides need not necessarily tend to be located on the outside. They may also be located further inward. The latching mechanism of the latching feature may therefore also be arranged internally. For accommodating a maximum number of gobos on a gobo wheel, however, it is of advantage to arrange the latching mechanism on the outside.

Finally it shall also be noted that, despite the fact that FIG. 5*a* shows a gobo wheel wherein at one position no gobo is mounted (element 58), it is also possible to build gobo wheels wherein all positions or fewer positions are occupied by gobo wheels.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A gobo holder for a gobo wheel, comprising:

a base element; and a gobo fastening element rotatably mounted to the base element, the base element comprising at least one resilient latching member configured to form a mechanical latching connection with a latching feature on the gobo wheel, by which mechanical latching connection the gobo holder may be detachably connected to the gobo wheel.

2. The gobo holder as claimed in claim 1, wherein the base element comprises at least one guide area configured to engage with a guide feature on the gobo wheel during a latching operation.

3. The gobo holder as claimed in claim 2, wherein the base element comprises two guide areas which are arranged at a distance from each other and are configured such that during a latching operation, they engage with guide features of the gobo wheel which are arranged at a distance from each other, so as to restrict, during the latching operation, a motion of the gobo holder in one direction orthogonal to a latching-motion direction.

4. The gobo holder as claimed in claim 3, wherein the base element comprises a flat area directed, in a latched state, to a center of the gobo wheel, the flat area comprising two opposed edges which form the guide areas, and the flat area comprising, between the edges, a slot extending from a rim.

5. The gobo holder as claimed in claim 1, wherein the resilient latching member is configured as an elastic lug shaped such that it extends above a surface of the base element formed in a planar manner.

6. The gobo holder as claimed in claim 1, wherein the resilient latching member comprises an elastic strip comprising an elevation which protrudes beyond the surface of the base element and which latches, in the installed state, into the latching feature on the gobo wheel.

7. The gobo holder as claimed in claim 6, wherein the elevation is created by a stamping tool.

8. The gobo holder as claimed in claim 6, wherein the elastic strip is integrally formed with the base element, however slots being arranged within the base element for defining the elastic strips so as to achieve elasticity of the strips.

9. The gobo holder as claimed in claim 1, wherein the base element comprises two separately arranged latching members arranged on a connecting line which is not parallel to a direction in which the gobo holder is moved when it is moved in relation to the gobo wheel so as to form the latching connection.

10. The gobo holder as claimed in claim 5, wherein the resilient latching member is configured integrally with the base element and comprises a first bending edge, where the latching member is connected to the base element, a second bending edge, which defines a sliding area on which the resilient latching member slides on the gobo holder when it is made to undergo the latching connection, and a latching area which extends away from the second bending edge.

11. The gobo holder as claimed in claim 1, wherein the base element comprises at least one vertical guide area arranged at or close to the resilient latching member, so that in order to create a latching connection, a vertical guide feature of the gobo holder exerts, during a motion of the gobo holder, a force which is directed perpendicularly to a plane of the base element and by means of which the resilient latching member is deflected from an unloaded idle position until latching occurs.

12. The gobo holder as claimed in claim 1, wherein the base element is trapezoidal and is directed, with a front area, to the center of the gobo wheel, and comprises a rear area wherein the latching members are arranged.

13. The gobo holder as claimed in claim 1, comprising precisely two latching members.

14. A gobo wheel for accommodating a gobo holder which comprises a resilient latching member, comprising:

a base plate comprising a recess for the gobo holder; and a latching feature configured to form a mechanical latching connection with the resilient latching member of the gobo holder, by which mechanical latching connection the gobo holder is detachably connected to the gobo wheel.

15. The gobo wheel as claimed in claim 14, wherein the latching feature exhibits no elasticity or a level of elasticity which is at least 10 times smaller than a level of elasticity of the resilient latching member of the gobo holder.

16. The gobo wheel as claimed in claim 14, wherein the latching feature comprises a depression within the base plate, or a perforation within the base plate.

17. The gobo wheel as claimed in claim 14, wherein the recess extends from a rim of the base plate to a center of the base plate, and wherein there are two latching features which are formed closer to the rim than to the center of the base plate next to the recess.

18. The gobo wheel as claimed in claim 14, wherein the base plate comprises at least one guide element which protrudes from the base plate and is configured and arranged to exert a force on the gobo holder during a motion in order to achieve latching.

19. The gobo wheel as claimed in claim 18, wherein the at least one guide element is configured to further exert a force on the gobo holder which is directed orthogonally to a plane of the base plate.

20. The gobo wheel as claimed in claim 14, wherein four guide pins are arranged on the base plate which each comprise a neck and a protruding head so as to exert a force, on a guide portion of the gobo holder, both in a direction parallel to the base plate and perpendicular to the base plate.

21. The gobo wheel as claimed in claim 20, wherein the guide pins are screwed, riveted, welded or adhesion-bonded to the base plate.

22. The gobo wheel as claimed in claim 14, configured to accommodate at least three gobo holders.

23. The gobo wheel as claimed in claim 22, comprising at least one guide element which is arranged and configured to engage with guide features of two adjacently arranged gobo holders at the same time.

24. The gobo wheel as claimed in claim 14, comprising at least one recess into which no gobo holder may be inserted and which is fully surrounded by the base plate.

25. A method of fastening a gobo holder, which comprises a resilient latching member, to a gobo wheel, which comprises a latching feature, the method comprising:

creating a relative motion between the gobo wheel and the gobo holder along a latching-motion direction for such time until the resilient latching member latches into the latching feature of the gobo wheel.

* * * * *